United States Patent [19]

Abe et al.

[11] 4,144,942

[45] Mar. 20, 1979

[54] METHOD OF SETTING A PILE WITHOUT NOISE OR VIBRATION AND APPARATUS THEREFOR

[75] Inventors: Nobuyuki Abe, Matsudo; Osamu Watanabe, Iwatsuki; Masami Tominaga, Tokyo; Koji Nunokawa; Ichiro Tanaka, both of Kamakura; Masao Manabe, Kawasaki, all of Japan

[73] Assignee: Nippon Concrete Industries Co., Ltd., Tokyo, Japan

[21] Appl. No.: 815,765

[22] Filed: Jul. 14, 1977

[30] Foreign Application Priority Data

Aug. 30, 1976 [JP] Japan ..... 51-102565

[51] Int. Cl.[2] ..... E21B 9/26; E02D 7/24

[52] U.S. Cl. ..... 175/286; 175/67; 175/171; 405/237

[58] Field of Search ..... 175/57, 21, 67, 171, 175/173, 284–289; 61/53.74

[56] References Cited

U.S. PATENT DOCUMENTS

| | | | |
|---|---|---|---|
| 3,077,235 | 2/1963 | Govin | 175/285 |
| 3,642,078 | 2/1972 | Dornfeld et al. | 175/171 |
| 3,839,875 | 10/1974 | Matushita | 61/53.74 |
| 3,848,683 | 11/1974 | Persson | 175/171 |
| 3,864,923 | 2/1975 | Tunzillo | 175/171 |
| 3,869,003 | 3/1975 | Yamada et al. | 175/171 |
| 3,938,344 | 2/1976 | Asayama | 61/53.66 |

*Primary Examiner*—Ernest R. Purser

*Attorney, Agent, or Firm*—Fidelman, Wolffe & Waldron

[57] ABSTRACT

This invention relates to a method of setting a pile without causing any noise or vibration. A hollow pile is erected along a leader fixed on the ground, a screw auger is inserted through the hollow center of the pile, the screw auger is hung on the leader in such a manner that it can freely move up and down and freely rotate, and the pile is sunk by its own weight as the soil below the bottom of the pile is excavated and the excavated soil is carried above the ground. The present invention further relates to an apparatus for executing the above method. The lower part of the screw auger is constructed in such a manner that it is divided into two parts, inner tube and outer tube, and both tubes can rotate through a certain angle and move up and down in a certain range relatively to each other. Excavating nozzles are disposed at the lower part of the screw auger in such a manner that they can be unfolded at several stages by the relative rotation and the vertical movement of the fluid is directed laterally from the nozzles to enlarge the hole below the pile.

5 Claims, 29 Drawing Figures

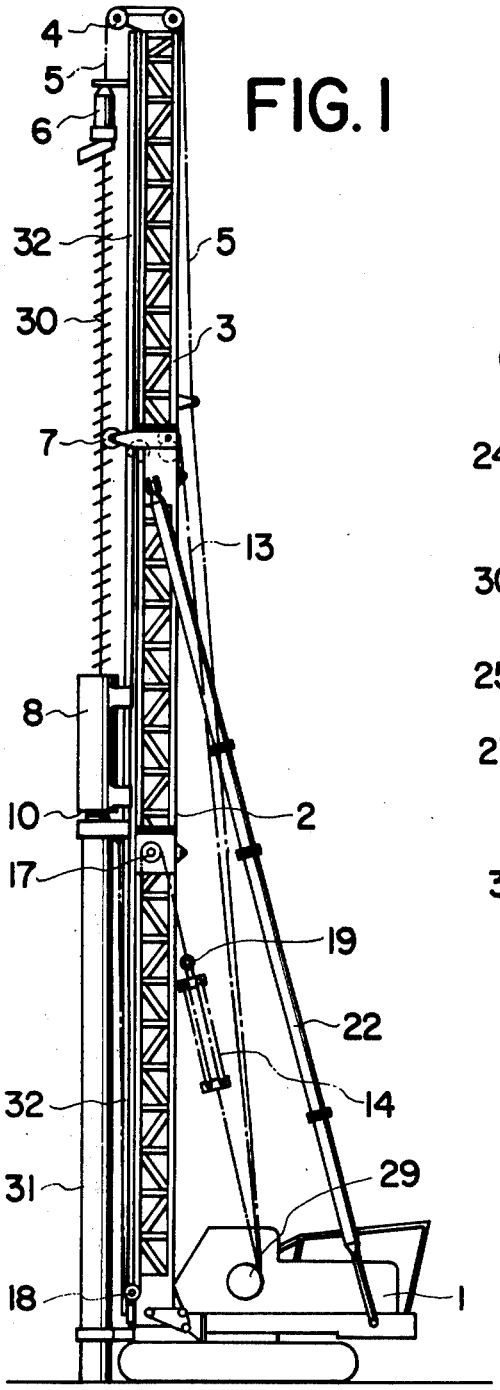
FIG. 1
FIG. 2
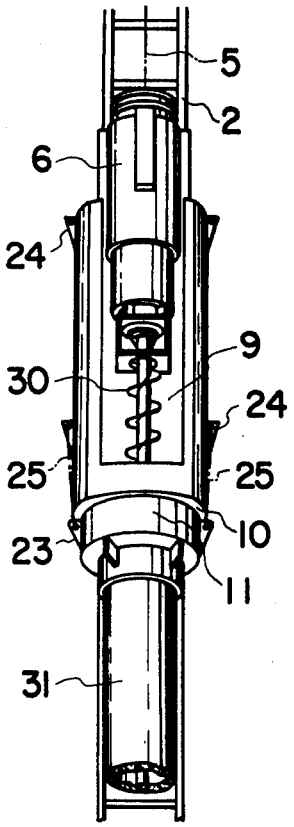

METHOD OF SETTING A PILE WITHOUT NOISE OR VIBRATION AND APPARATUS THEREFOR

SUMMARY OF THE INVENTION

This invention relates to a method of setting a pile without causing any noise or vibration and an apparatus therefor.

In a basic work of driving concrete piles into earth on which a building is constructed, a diesel hammer has been generally used to give blows on top of a concrete pile. This conventional method has caused severe vibration of earth and much noise. Moreover, oil has dispersed at the time of acting a diesel hammer.

In order to eliminate the above defects, another method has been recently employed in which a leading hole is previously bored at a position where a concrete pile is intended to be set and the concrete pile is sunk into the leading hole, so that any vibration is not caused at the time of setting a concrete pile.

The present invention is to improve the above method and to provide an apparatus in which outer diameter of a forward end of a screw auger for boring can be changed at several stages. The main object of the present invention is to eliminate vibration and noise which have been caused in a conventional method. The second object of the present invention is to provide an apparatus in which different diameter holes can be continuously bored, an independent device for changing the diameter of a hole is not required, and relatively simple operation is possible by utilizing the self-weight of a screw auger and soil-pressure resistance caused at the time of boring. Other objects and features of the present invention will be apparent in the embodiments described later.

BRIEF DESCRIPTION OF THE DRAWINGS

FIG. 1 is a side elevation view showing how to use an apparatus to execute the method of the present invention;

FIG. 2 is a fragmentary enlarged view showing the relationship between a counter-weight and a screw auger of the apparatus of FIG. 1;

FIG. 12 is a sectional elevation view showing a condition that a bit disposed at the lower part of a screw auger is closed in its use;

FIG. 13 is a sectional elevation view showing a condition that the said bit is opened so that the outer diameter of the bit is the same as that of the pile;

FIG. 14 is a sectional elevation view showing a condition that the said bit is opened at maximum;

DETAILED DESCRIPTION OF THE INVENTION

Figure 3:
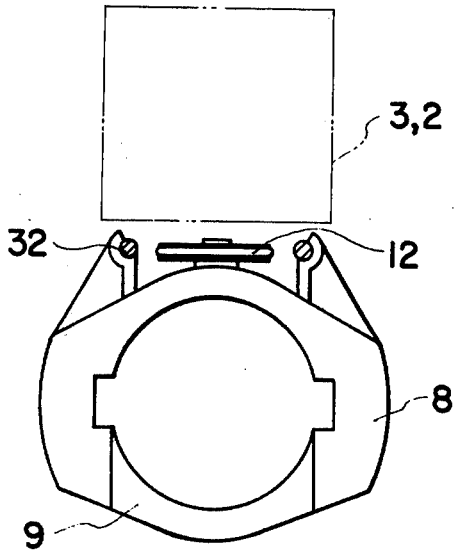
FIG. 3 is a plan view showing how to attach the counter-weight.

FIG. 1 is a side elevation view of an apparatus for executing the method of the present invention. A main leader (2) is erected very close to a main body (1) which is a car or a fixed body. The main leader (2) can be taken into pieces. A supplementary leader (3) is attached to the top of the main leader (2).

Top sheaves (4) are disposed at the top of the supplementary leader (3). A wire (5) drawn from a drum (29) of the main body (1) is wound around the top sheaves (4) in order to suspend an auger machine (6). The auger machine (6) consists of a motor, a retarding device, and a soil exhausting hole. A screw auger (30) is connected with the bottom of the auger machine (6) so as to be driven by the machine. Reference numeral (22) designates a leader supporting arm, and the inclining angle of the arm (22) can be freely adjusted.

A middle sheave (7) is attached in front of the upper part of the main leader (2). The middle sheave (7) is used to lift a concrete pile (31) and to erect it along the main leader (2).

A counter-weight (8) is attached to the main leader (2) below the middle sheave (7) in a freely slidable manner. The counter-weight (8) is hollow and has an opening (9) in front as shown in FIGS. 2 and 3. The lower part of the counter-weight (8) is formed into a cylinder with no opening so that the bottom is used as an annular striking surface (10). The auger machine (6) can be freely inserted into the counter-weight (8).

FIG. 2 is a perspective view showing the auger machine (6), the counter-weight (8) and the pile (31). The top of the pile (31) is covered with a cap (11).

FIG. 3 is a partially cut plan view showing how to attach the counter-weight (8) to the main leader (2). Reference numeral (32) designates two guide shafts which are engaged with the counter-weight (8) so as to guide the vertical movement of the counter-weight (8). The two guide shafts (32) are disposed in front of the main leader (2) in parallel with each other. Reference numeral (12) designates a sheave for lifting the counter-weight (8).

Figure 4:
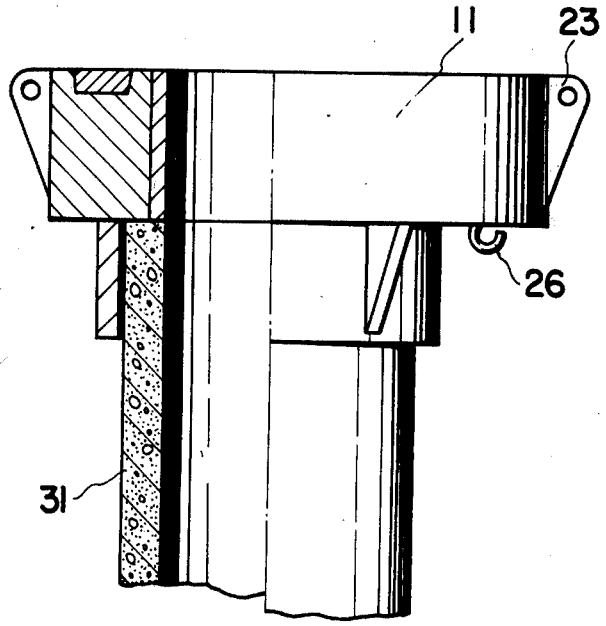
FIG. 4 is a partially sectional side elevation view of a cap for supporting a pile.

FIG. 4 is a partially sectional elevation view showing how to cover the top of the pile with the cap (11). Two projections (23) are formed on both sides of the cover (11). As shown in FIG. 2, wires (25) are put between projections (24) formed on both sides of the counter-weight (8) and the said projections (23) of the cap (11). The cap (11) is also guided by the guide shafts (32) in a freely slidable manner similarly to the counter-weight (8). Reference numeral (26) designates a wire hook attached to the lower surface of the cap (11).

Figure 5:
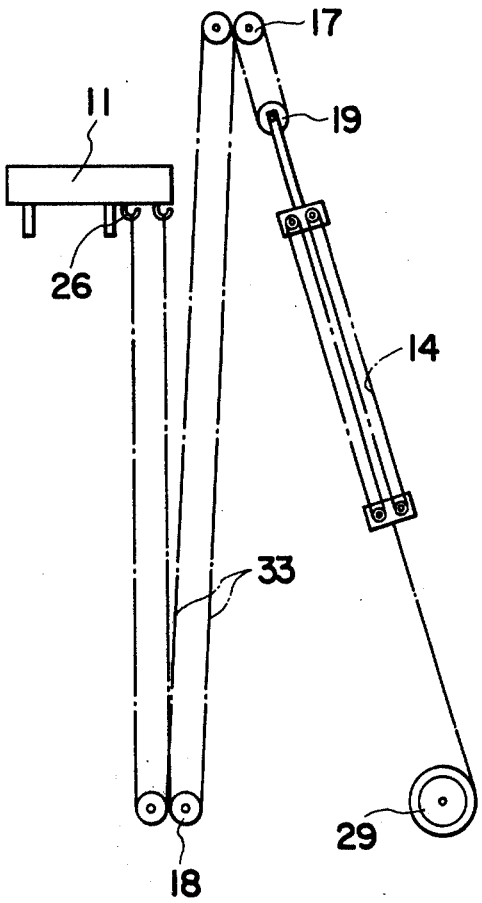
FIG. 5 is a view showing a basic structure of a device for withdrawing a pile.

FIG. 5 is a view for explaining the principle of a device for withdrawing a pile. A withdrawing wire (33) is wound around fixed sheaves (17) and (18). Two sheaves (17) are disposed at the middle position of the main leader (2), and two sheaves (18) are disposed at the lowest position of the main leader (2). Both ends of the wire (33) are engaged with the hooks (26) fixed to the lower surface of the cap (11). Reference numeral (14) designates middle wires for driving the wire (33) through a sheave (19). The middle wires (14) are pulled by a wire drawn from the drum (29) of the main body (1). Four or more middle wires (14) are required because the ropes are subjected to the whole weight of the apparatus at the time of withdrawing the pile.

Figure 6:
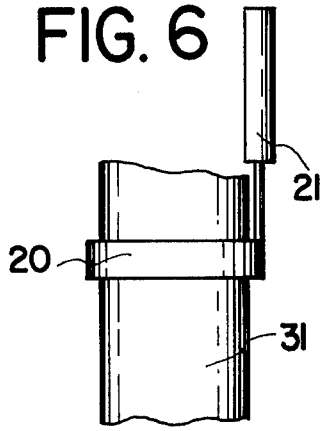
FIG. 6 is a fragmentary view of a pressing device utilizing oil-pressure.

FIG. 6 is a side elevation view of a pile pressing device (21) disposed at the lower part of the main leader (2). The pile pressing device (21) consists of an oil-pressure cylinder and a chuck (20) for fixing the pile. Counter force caused at the time of pressing the pile by the cylinder is given to the main leader (2), i.e. the main body (1).

As apparent from the abovementioned drawings, the top sheaves (4) are disposed above the supplementary leader (3), and when the main and supplementary leaders are perpendicularly erected, the auger machine (6) and the screw auger (30) are disposed on the axial center line of the counter-weight (8) and the cap (11).

Each part described above acts independently or relatively. The method of pressing a concrete pile with the apparatus shown in FIGS. 1 to 6 will be described hereinafter.

The auger machine (6) is pulled up by the top sheaves (4) disposed above the supplementary leader (3) as high as possible, and the hollow concrete pile (31) is erected by the middle sheave (7).

After the head of the concrete pile (31) is covered with the cap (11), th auger machine (6) is descended so that the screw auger (30) is inserted into the pile through the cap (11). When the forward end of the screw auger (30) is positioned 0.5 to 1.0 m. below the bottom of the pile, pressing of the pile is started. At that time, the auger machine (6) is generally placed within the counter-weight (8).

The screw auger (30) is driven by the auger machine (6) so as to excavate soil below the bottom of the pile. The excavated soil is carried with the screw auger and exhausted from and exhaustion hole. Therefore, the pile (31) is sunk by the self-weight. Even if the pile (31) is not sunk after the excavated soil is exhausted, the counter-weight (8) is made free and placed on the cap (11) so that the weight of the counter-weight can be given to the top of the pile.

If much friction is caused between the screw auger (30) and the inner wall of the pile (31), and the sinking of the pile is interrupted by the stop of the screw auger (30) and the stop of the exhaustion of soil, the auger machine (6) is pulled up so as to accelerate the soil-exhaustion in order to remove the friction. Otherwise, the auger machine (6) may be united with the counter-weight (8) in order to give the weight of the counter-weight to the screw auger (30), or an oil-pressure device (21) may be used to catch the pile (31) and push it down.

If it is impossible to sink the pile even with the abovementioned supplementary actions, wires (14) and (33) are pulled so as to activate a drawing device utilizing counter force in such a manner that the whole weight of the main body (1) and the leaders are given to the pile through the cap (11), or the counter-weight (8) is repeatedly descended so as to strike the cap (11).

FIGS. 11 (A) to 11 (D) are views showing how to sink a pile in accordance with the nature of the soil. In FIG. 11 (A), an excavator the diameter of which can be changed is attached to the forward end of a screw auger (30) in order to dig a hole the diameter of which is the same as the outer diameter of a pile. This is good for sand or weak silt the N-valve of which is less than 5. If soil exhaustion is satisfactorily performed, a pile is sunk without any trouble.

In FIG. 11 (B), the diameter of a hole is a little smaller than the outer diameter of a pile. This is good for tight sand or hard clay. In FIG. 11 (C), the diameter of a hole is the same as the inner diameter of a pile. This is good for hard soil or gravel. In FIG. 11 (D), a steel tube is attached to the bottom of a pile, and the diameter of a hole is the same as the outer diameter of the pile. This is good to reduce the resistance at the bottom of a pile and the friction at the outer periphery of a pile.

In any method of FIGS. 11 (A) to 11 (D), a drawing device utilizing counter force of an oil-pressure pushing device may be used, or the striking may be performed with the counter-weight as required in order to securely sink a pile at a desired position.

After the pile is sunk through a desired distance, the counter-weight (8) is pulled up by about 2 meters and descended so as to strongly strike the cap (11). Therefore, the bottom of the pile is positioned lower than the bottom of the screw auger (30), and thereby required supporting force can be obtained. Even though vibration and noise are caused at the final step, any vibration or any noise is not caused during the whole process except only the final step. Moreover, sufficient supporting force can be securely obtained by the striking performed with the counter-weight.

The screw auger (30) may be connected with additional one or replaced with other one. The counter-weight (8) is a hollow body having the opening (9) so as to contain the auger machine (6). However, the lower part of the counter-weight is a cylinder with no opening, and the striking surface (10) is annular. Therefore, the head of the pile can be struck equally on the whole part thereof. Reference numeral (32) designates guide shafts attached to the leaders (2) and (3) in order to support the auger machine, the counter-weight and the cap.

In the present invention, the sheaves for suspending the auger machine are provided at the top, and the sheave for pressing the pile is provided at the middle. Therefore, unlike the conventional case that the suspension is executed only at the top, a wire is never tangled and the suspension can be properly performed. Eventhough the suspension is performed at two points, the axial center is the same. Therefore, when the pile is erected, the screw auger is automatically inserted into the pile. Accordingly, unstable and dangerous work can be prevented in which a screw auger is previously inserted into a laid pile, and when the pile is erected, the pile and the screw auger are separately supported at high positions.

FIGS. 7 to 10 are views showing other embodiment of the apparatus for executing the method of the present invention, in which some parts shown in FIGS. 2 to 5 are altered.

Figure 7:
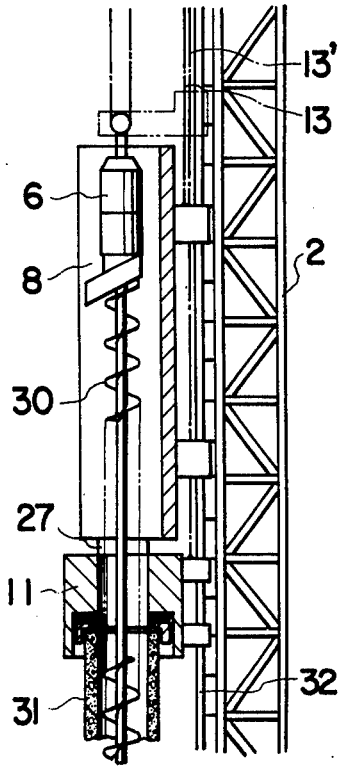
FIG. 7 is a partially sectional side elevation view of an apparatus of another embodiment.

FIG. 7 is a partly sectional side elevation view corresponding to FIG. 2. The counter-weight (8) and the cap (11) are separately suspended with the wires (13) and (13'), and the shapes of the counter-weight (8) and the cap (11) are different from those shown in FIG. 2.

Figure 8:
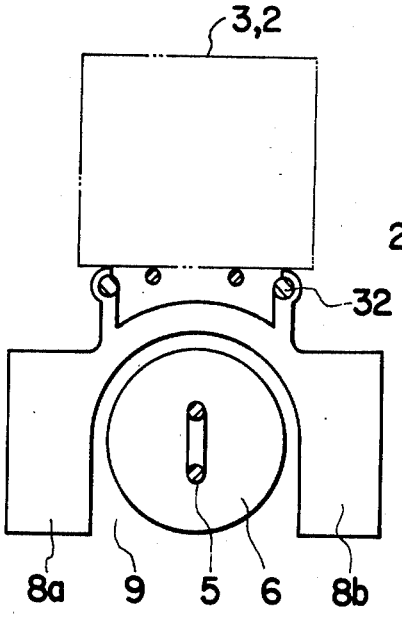
FIG. 8 is a plan view of a counter-weight shown in FIG. 7.

FIG. 8 is a plan view of the counter-weight (8). Since the front of the counter-weight (8) is open, its weight is decreased by the weight of the front wall. Therefore, side walls (8*a*) and (8*b*) are made thick in order to increase the self-weight of the counter-weight, so that the sinking load of the pile is increased.

Figure 9:
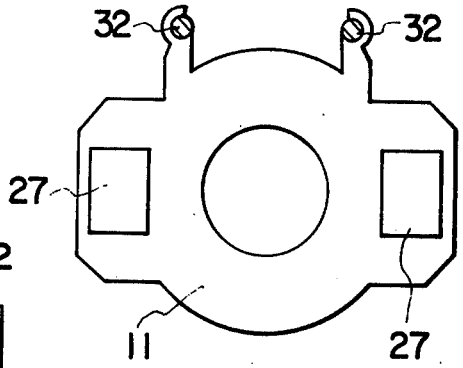
FIG. 9 is a plan view of a cap for supporting a pile shown in FIG. 7.

FIG. 9 is a plan view of the cap (11). Similarly to the counter-weight (8), weight increasing parts are formed on both sides. Two projections (27) are formed on the upper surfaces of the weight increasing parts so that balanced striking force is given.

Figure 10:
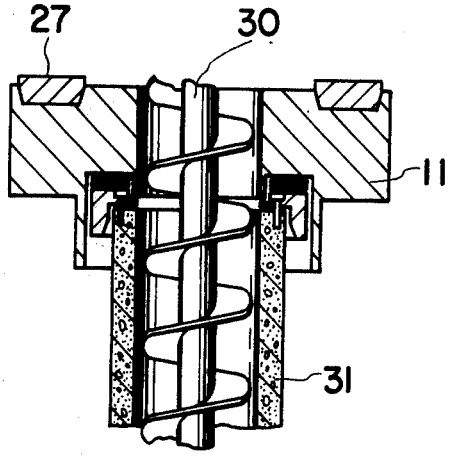
FIG. 10 is a sectional elevation view showing how the cap is engaged with the pile.
Figure 11A:
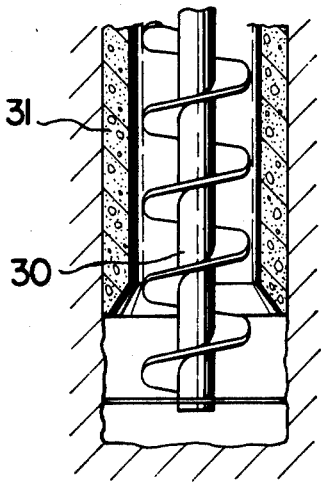
FIGS. 11 (A), 11 (B), 11 (C) and 11 (D) are fragmentary sectional views showing four embodiments of the method of the present invention.
Figure 11B:
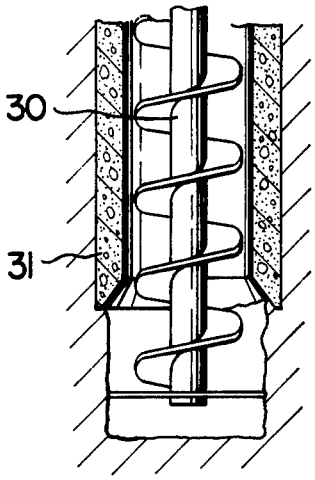
Figure 11C:
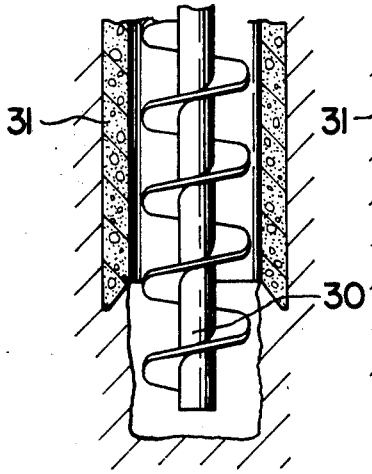
Figure 11D:
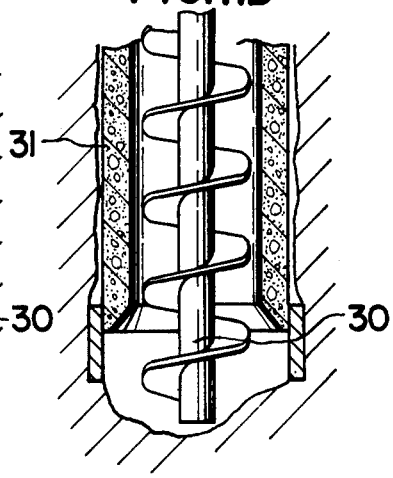

FIG. 10 is a front sectional elevation view of the cap (11). Unlike FIG. 4, it is not drawn with a wire, but it is subjected to only the load of the counter-weight (8). The operation and action of the apparatus shown in FIGS. 7 to 10 are basically the same as those of the apparatus shown in FIGS. 1 to 5.

Figure 12:
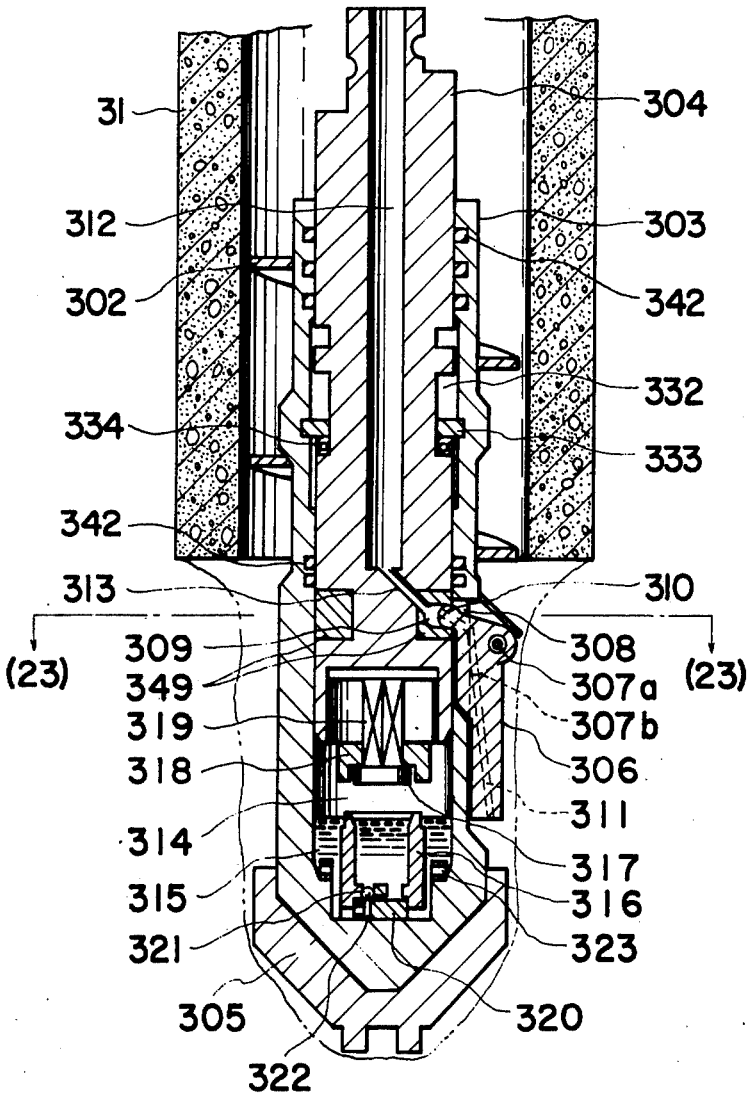
FIGS. 12 to 14 show various conditions of a screw auger used in the method of the present invention.
Figure 13:
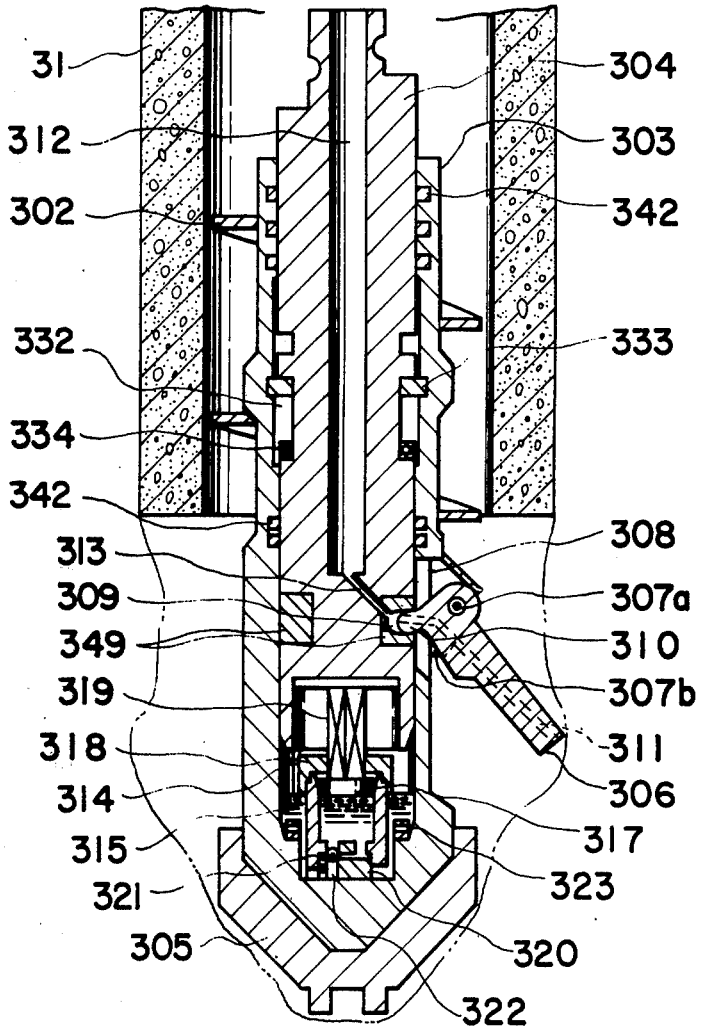
Figure 14:
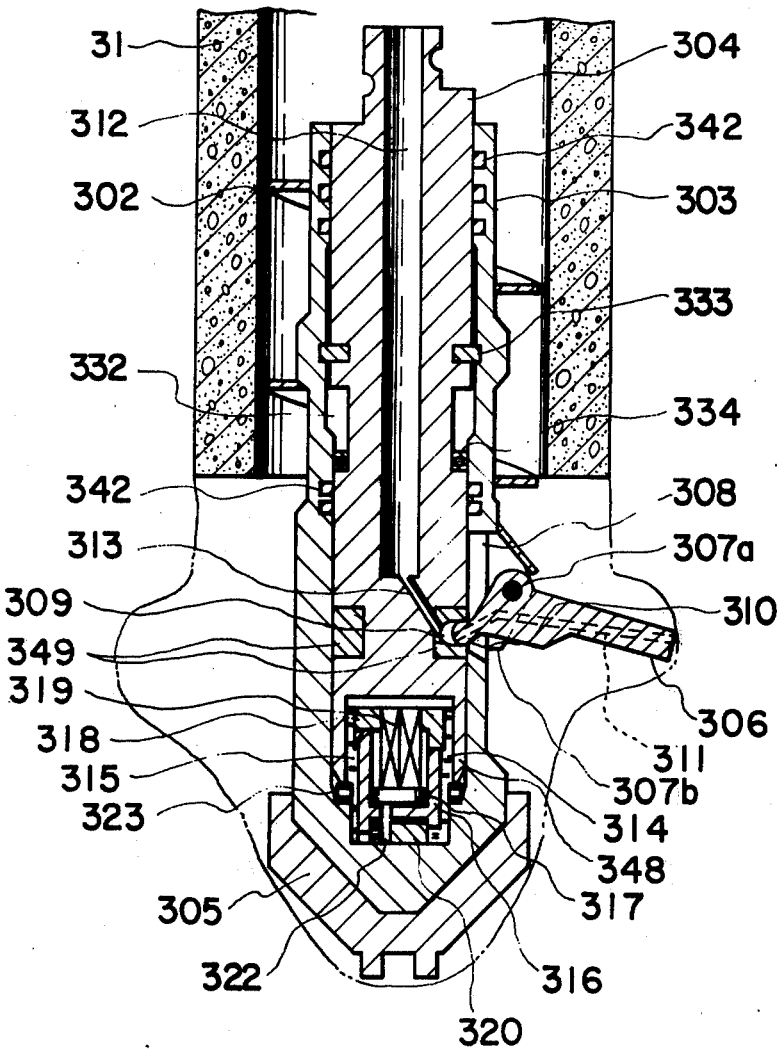

FIGS. 12 to 23 are views showing the structure of the forward end of the screw auger and the operating mechanism thereof. A bit is shown which can excavate a normal hole for sinking a pile thereinto, holes shown in FIGS. 11 (A) to 11 (D), and a large diameter hole which is shown in FIG. 14 and is used for supporting the forward end of a pile.

The bit shown in FIGS. 12 to 23 is used for executing the abovedescribed method of setting a pile without noise or vibration. The bit of the present invention can continuously excavate a hole for sinking a pile thereinto and a large diameter hole for supporting the forward end of the pile. The object of the present invention is to provide an apparatus in which different diameter holes are continuously excavated without replacement of an excavator, diameter of a hole can be changed without an independent driving device by utilizing the self-weight of an excavator and soil-pressure resistance, and such excavation can be executed without causing any shock or any damage of equipments due to shock.

FIGS. 12 to 14 are sectional elevation views showing the working conditions of a bit and relate to the structure of the forward end of a screw auger inserted through the hollow part of a concrete pile (31). Namely, the forward end of the screw auger consists of an outer tube (303) having a screw vane (302) on the outer periphery thereof and an inner tube (304) which can vertically slide and rotate in a certain range within the said outer tube. Other various equipments are also provided. Reference numeral (305) designates several excavating edges fixed to the bottom of the outer tube (303). Several nozzles (306) are attached on the outer periphery of the outer tube (303). The nozzles (306) are supported in a freely rotatable manner by brackets (307*b*) fixed to the outer tube and pins (307*a*). The top (310) of the nozzles (306) is projecting to the inside of the outer tube (303) beyond the window (308) formed at the attaching position of the nozzles. The top (310) is formed into a cylinder which can be put within a groove (309) formed on the outer periphery of a split-bush (349) attached on the outer periphery of the inner tube (304). A hole (311) is formed inside the nozzles (306) in such a manner it is passing from the top (310) to the bottom. The hole (311) is used to pass air or pour cement milk, and is always connected with a hollow part (312) of the inner tube (304) through a connecting hole (313) connecting the said groove (309) with the said hollow part (312). If the outer and inner tubes (303) and (304) relatively slide in the axial direction, the nozzles (306) are turned around the pins (307*a*) as shown in FIGS. 13 and 14 so as to change the diameter of a hole to be excavated with the said nozzles.

Figure 23:
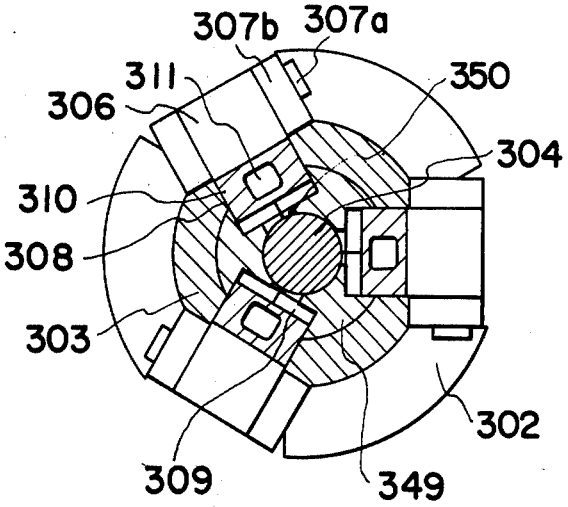
FIG. 23 is a sectional view along the line (23) — (23) of FIG. 12 concretely showing the engagement of nozzles with connecting holes provided within an inner tube.

During the excavation, air or cement milk is always poured from the forward ends of the nozzles (306). FIG. 23 is an enlarged sectional plan view along the line (23) — (23) of FIG. 12 in which three nozzles (306) are provided. The annular split bush (349) has the grooves (309) into which the top parts (310) of the nozzles (306) are fitted. Connecting holes (350) are formed at the split bush (349) in such a manner that the hollow part (312) of the inner tube (304) is always connected with the holes (311) of the nozzles (306) even when the nozzles are turned through a certain angle with respect to the inner or outer tube. Since the holes (311) of the nozzles (306) attached to the outer tube (303) are connected with the said holes (350) of the bush (349), the bush (349) is disposed in such a manner that it can be freely rotated without regard to the rotation of the inner tube (304), so that even when the inner tube (304) is rotated, the bush (349) is not rotated.

An oil-pressure chamber (314) is provided within the outer tube (303) below the inner tube (304). The chamber (314) contains oil (315) of a certain volume and is provided with the cylinder (316), the top of which is open, at the bottom thereof in such a manner that it is rotatable in a certain range. A supporter (323) for the inner tube (304) is further provided at the bottom of the oil-pressure chamber (314). A piston (317) is provided below the bottom of the inner tube (304) in such a manner that it can be inserted into the said cylinder (316).

A chuck (318) is attached on the outer periphery of a piston rod (319) disposed at the bottom of the inner tube (304) in such a manner that it is not rotatable, but is freely slidable. When the piston (317) is inserted into the cylinder (316), the chuck (318) is engaged with the top of the cylinder (316). Therefore, if the inner tube (304) is rotated in a certain range with respect to the outer tube (303), the cylinder (316) also rotates by the said engagement so that a ball-valve (321) disposed at the bottom of the cylinder (316) is opened or closed.

Figure 17:
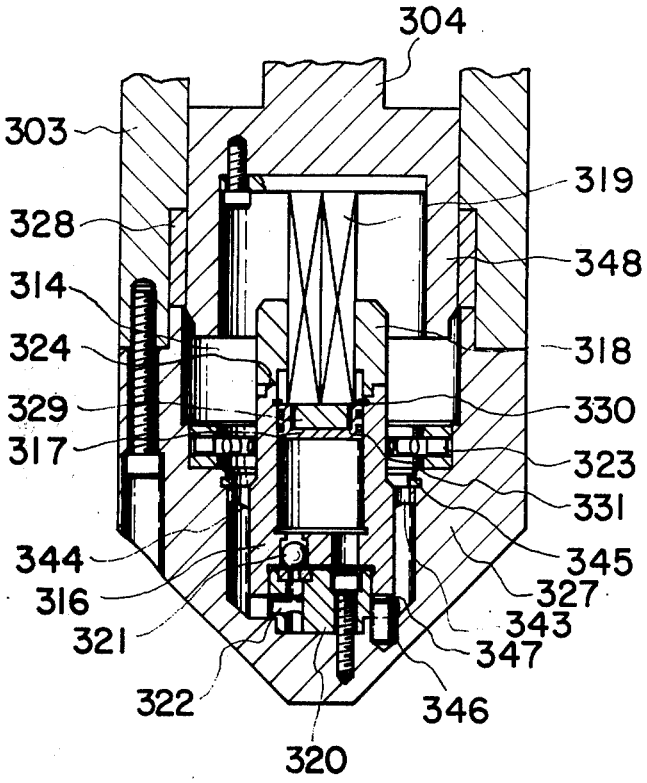
FIG. 17 is an enlarged sectional elevation view of a bit in other embodiment.

As shown in FIG. 17, the cylinder (316) is engaged with a bed-seat (320) in a freely rotatable manner which is fixed to the outer tube at the bottom of the oil-pressure chamber (314) and has an oil passage (322). A flange (344) having another oil passage (343) is disposed at the middle of the cylinder (316) on the outer periphery thereof. The said flange (344) is fixed in a freely rotatable manner with a snap ring (345) disposed on the inner periphery of the outer tube. A notch (347) is formed at the bottom of the cylinder (316) so that a stopper (346) to regulate the rotation of the cylinder in a certain range can be inserted thereinto. The said stopper (346) is fixed to the outer tube at the bottom of the oil-pressure chamber (314) with a screw or by pushing.

A supporting mechanism for the bit will be described hereinafter referring to FIGS. 12 to 14.

In FIG. 12, the screw auger is inserted through the hollow part of the concrete pile (31). The nozzles (306) are closed by the self-weight thereof. The outer tube (303) with the nozzles (306) is supported in such a manner that the bottom surfaces of keys (333), inserted into notches formed on the inner surface of the middle part of the outer tube (303) and fixed there, are in contact with the upper surface of a supporter (334) comprising a thrust bearing inserted into a groove formed on the outer periphery of the middle part of the inner tube (304). In this case, the piston (317) is free from the cylinder (316).

In FIG. 13, the nozzles (306) are unfolded at a first stage so as to excavate a hole the diameter of which is approximately the same as the outer diameter of the concrete pile (31). The outer tube (303) is pushed upward by soil-pressure resistance caused by the excavation, and the piston (317) disposed below the inner tube (304) is inserted into the cylinder (316) disposed at the bottom of the oil-pressure chamber (314). Therefore, oil pressure is caused against the soil-pressure resistance so as to support the outer tube (303). Even if the oil pressure is lowered by the leakage of oil, the upper surfaces of the keys (333) fixed to the outer tube (303) contact the lower surface of a projection part (337) formed above the supporter (334) attached to the inner tube (304) so as to support the outer tube. Accordingly the nozzles (306) are not further unfolded.

In FIG. 14, after the hole is excavated through a desired distance, the nozzles (306) are further unfolded at the second stage so as to excavate another hole for supporting the forward end of the concrete pile. Another cylinder (348) is formed at the bottom of the inner tube (304) in such a manner that it can surround the cylinder (316). The said cylinder (348) contacts the supporter (323) comprising a thrust bearing fixed to a step formed on the inner periphery of the outer tube (303) within the oil-pressure chamber (314) so as to support the outer tube. Solidifying material such as cement milk is poured from the forward ends of the nozzles (306), and the screw auger is moved up and down so as to stir the solidifying material. At that time, the lower surfaces of the keys (333) fixed to the outer tube (303) is in contact with the upper surface of the projection part (337) formed at the middle of the inner tube (304) so as to prevent the drop of the outer tube (303).

A mechanism to unfold the nozzles (306) from the first stage to the second stage and a mechanism to transmit the rotation of the inner tube (304) connected with the screw auger to the outer tube (303) will be described hereinafter.

Figure 18:
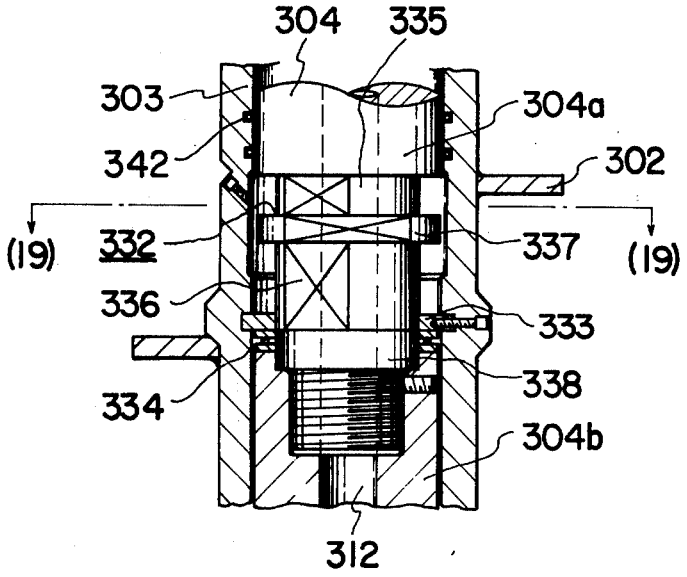
FIG. 18 is a sectional elevation view showing a mechanism for ascending and descending the screw auger of FIGS. 12 to 14.
Figure 19:
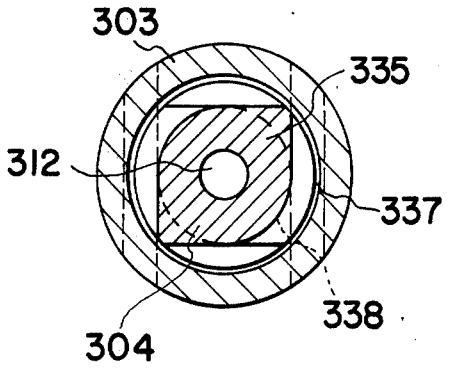
FIG. 19 is a sectional view along the line (19) — (19) of FIG. 18.

FIG. 18 is a sectional elevation view showing such mechanism. The inner tube (304) is divided into an upper inner tube (304*a*) and a lower inner tube (304*b*). Both tubes are fixed to each other with screws or the like. A different diameter part or portion (332) is formed at the lower part of the upper inner tube (304*a*). Two keys (333) are fixed to the outer tube (303) at the position corresponding to the said different diameter part portion (332). By utilizing the positional relation of the said different diameter part (332) to the said keys (333), the nozzles (306) are unfolded at the first stage and further unfolded at the second stage, and the rotation of the inner tube (304) is transmitted to the outer tube (303). Moreover, the upper part of the upper inner tube (304*a*) is constructed such that it can be connected to the screw auger.

The different diameter part or portion (332) comprises four parts, small diameter parts or portion (338), (336) and (335), and a projection part (337). The supporter (334) comprising a thrust bearing is attached to the first small diameter part (338). The second small diameter part (336) is composed of first two flat surfaces which come into contact with the keys (333) so as to convey the rotation of the inner tube (304) to the outer tube (303), and of second two flat surfaces which act as stoppers so that the projection part (337) can be reversed through a certain angle and can pass between the two keys (333). The projection part (337) comprises a projection the diameter of which is larger than the distance between the keys (333) and two flat surfaces by which this part can pass between the keys (333). Third small diameter part (335) is formed similarly to the second small diameter part (336).

Figure 20A:
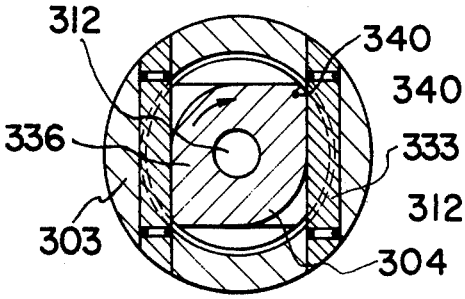
FIGS. 20 (A), 20 (B) and 20 (C) are sectional plan views showing the working conditions of the mechanism of FIG. 18.
Figure 20B:
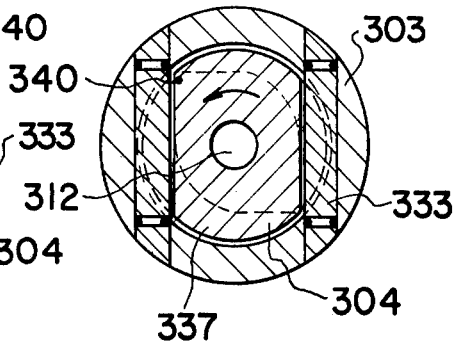
Figure 20C:
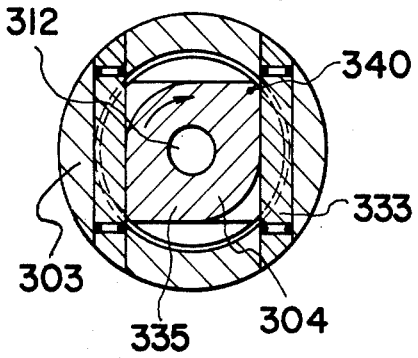

FIGS. 20 (A) to 20 (C) are sectional plan views of the different diameter part (332).

Reference numeral (340) designates a fixed point by which the movement of the different diameter part (332) of the inner tube (304) is shown with respect to the keys (333) of the outer tube (303). At the condition shown in FIG. 20 (A), the nozzles (306) are closed or unfolded at a first stage, the keys (333) are engaged with the lower small diameter part (336), the inner tube (304) rotates in a normal direction so as to rotate the outer tube (303) through the keys (333), and the inner and outer tubes are slidable up and down.

At the condition shown in FIG. 20 (B), the nozzles (306) are going to be unfolded from the first stage to the second stage, the inner tube (304) is reversed through 60° or 90° with respect to the outer tube (303) (In the drawing, it is rotated through 90°.), and the projection part (337) can pass between the keys (333).

At the condition shown in FIG. 20 (C), the projection part (337) passes between the keys (333), the upper small diameter part (335) comes into contact with the keys (333), and the inner tube (304) is rotated in a normal direction through a certainangle, so that the nozzles (306) are held in the second unfolded condition. If the inner tube (304) is reversed through a certain angle and the screw auger is withdrawn, the nozzles (306) are closed by the self-weight thereof through the conditions shown in FIGS. 20 (B) and 20 (A).

Figure 22:
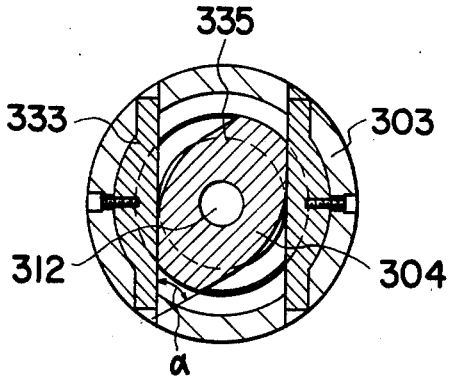
FIG. 22 is a sectional plan view in other embodiment corresponding to FIGS. 20 (A) and 21 (A)

Although the inner tube (304) is rotated through 90° in FIGS. 20 (A) to 20 (C), a suitable rotating angle is decided in accordance with the shape of the upper and lower small diameter parts (335) and (336). For example, as shown in FIG. 22, a suitable rotating angle is decided by the angle (d) formed by one side of the first two flat surfaces which come into contact with the keys and one side of the second two flat surfaces. If the position where the upper inner tube (304*a*) is joined with the lower inner tube (304*b*) is changed in accordance with the decided rotating angle, the positional relation of the different diameter part (332) to the keys (333) is sufficient to execute the abovementioned operation.

Hereinafter, the operation of the oil-pressure chamber (314) in case of holding the nozzles (306) in the first unfolded condition and further unfolding the nozzles to the second stage will be explained referring to FIGS. 15, 16 and 17.

Figure 15:
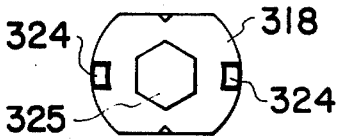
FIG. 15 is an enlarged plan view of a part inside the said bit.
Figure 16:
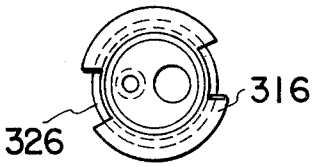
FIG. 16 is an enlarged plan view of other part inside the said bit.

In FIGS. 15 and 16, there is shown the construction for transmitting the rotation of the piston rod (319), which rotates together with the inner tube (304), to the cylinder (316). In FIG. 15, a hole (325) for inserting the piston rod (319) a cross section of which is a hexagonal shape is provided at the center of the cover (318). Two projections (324) are provided at the lower surface of the cover (318) near the outer periphery so that the cover (318) can be engaged with the top of the cylinder (316).

In FIG. 16, two notches (326) are formed at the top of the cylinder (316) at the positions corresponding to the projections (324). The projections (324) are put into the notches (326) and can be turned through a certain angle within the notches. If the projections (324) turn over the limited range, the cover (318) and the cylinder (316) are turned simultaneously by the engagement of the projections (324) with the notches (326).

Reference numeral (327) designates a housing disposed below the bottom of the outer tube (303). The housing (327) is constituting the oil-pressure chamber (314), and fixed to the outer tube (303) with bolts or the like. A sealing material (328) is inserted between the inner periphery of the outer tube (303) and the outer periphery of the cylinder (348) projecting beyond the bottom of the inner tube (304). Unlike the aforesaid piston integrally fixed to the inner tube (304), the piston shown in FIG. 17 is separated away from the inner tube (304) and has a magnet (329) fixed therein through a non-magnetic material (331).

In the condition the nozzles (306) are closed, the bottom of the inner tube (304) is positioned above the cylinder (316) as shown in FIG. 12. When soil-pressure resistance is caused at the bottom of the outer tube (303), the outer tube (303) slides up with respect to the inner tube (304) by the said resistance, and the nozzles (306) are unfolded to the first stage as shown in FIG. 13. At that time, the piston (317) attached below the bottom of the inner tube (304) is inserted into the cylinder (316) so that the ascent of the outer tube (303) is controlled by the oil-pressure within the cylinder. Thereafter, the inner tube (304) is reversed through a certain angle with respect to the outer tube (303). Since the soil-pressure resistance exists at the bottom of the outer tube (303), the outer tube (303) slides up, and thereby the nozzles (306) are further unfolded to the second stage as shown in FIG. 14. In this case, first the forward end (chuck) of a cover (318) attached to the piston rod fixed to the bottom of the inner tube (304) is engaged with the top of the cylinder (316). Therefore, when the inner tube (304) is reversed through a certain angle with respect to the outer tube (303), the cylinder (316) is also rotated. A ball (321) is inserted between the bottom of the cylinder (316) and the bed-seat (320), and an oil passage (322) is opened or closed by utilizing the ball (321). The ball (321) is rolled on the bed-seat (320) in accordance with the rotation of the cylinder (316) with time difference. Therefore, the oil-passage (322) is opened so that the oil within the cylinder (316) is exhausted into the oil-pressure chamber (314) and the outer tube (303) slides up with respect to the inner tube (304).

In the abovementioned bit, air or a hardening material such as cement milk can be always poured out therefrom during the excavation, and the oil-passage (322) within the cylinder (316) can be opened when the nozzles (306) are further unfolded from the first stage to the second stage. If the inner tube (304) is rotated through a certain angle with respect to the outer tube (303), the positional relation of the inner tube (304) to the outer tube (303) changes so that the abovementioned operation can be executed. As described before, the rotating angle is decided by an angle ($\alpha$) formed by one side of the first two flat surfaces which come into contact with the keys and one side of the second two flat surfaces of the inner tube.

Figure 21A:
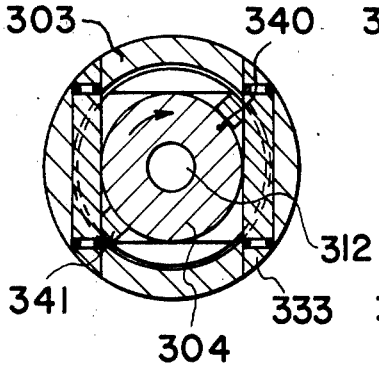
FIGS. 21 (A) and 21 (B) are sectional plan views in other embodiments respectively corresponding to FIGS. 20 (A) and 20 (B)
Figure 21B:
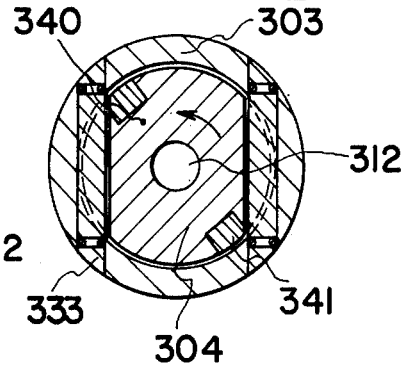

FIGS. 21 (A) and 21 (B) show other embodiment of the different diameter part of the inner tube and correspond to FIGS. 20 (A) and 20 (B). In the present embodiment, reinforcing members (341) are attached to the corner surfaces in a freely removable manner, which are subjected to the maximum moment by contacting the keys, so as to prevent the abrasion or the damage due to shock, improve the durability and loosen the shock. The shape of the different diameter part can be optionally selected from the points of accuracy of operation, efficiency and processing cost. For example, pawls or other projections are formed on the outer surface of the inner tube and the corresponding concave or convex parts are formed on the inner surface of the outer tube.

Sealing from the outside with a sealing material (342) or supply of a lubricant to sliding parts of the inner and outer tubes may be performed as required.

The effects of the abovedescribed bit are as follows.

Since the flat surfaces of the inner tube come into contact with the flat surfaces of the contacting parts of the outer tube every time the inner tube rotates through a certain angle, for example 60° or 90°, the operation at the time of starting or switching is smooth, and thereby the damage of the contacting surfaces can be prevented.

The inner and outer tubes are supported at the lower part thereof by the piston and the cylinder disposed below the inner tube utilizing the oil-pressure. Therefore, the operation is smooth and any shock is not caused. The said operation utilizing the oil-pressure is performed in connection with the operation for the vertical movement of the tubes at the upper part thereof through a ball-valve disposed at the bottom of the cylinder.

Since the inner and outer tubes are supported by the upper and lower parts thereof, any part of the tubes are not subjected to a concentrated load during the vertical movement thereof, and they can be securely supported.

In case that the piston head is divided, the abrasion of the sealing material such as O-ring can be prevented, and thereby mixture of air can be prevented. Therefore, oil can smoothly flow and deterioration of oil can be prevented.

In case that a magnet is used at the piston head, wasteful stroke can be avoided in comparison with the case that a spring is used in order to return a piston head inserted into a cylinder, and further the length of the forward end of the bit can be made shorter.

We claim:

1. An excavating apparatus, in which a screw auger is inserted through the center of a hollow pile and said pile is sunk by its own weight as soil below the bottom of said pile is excavated and the soil is exhausted above the ground, comprising:

(1) an outer tube including: an auger vane attached on the outer periphery thereof, a plurality of nozzles rotatably attached to said outer tube which can be turned outward, and keys protruding inwardly from the inner surface of said outer tube; and (2) an inner tube positioned in said outer tube, said inner tube including different diameter portions, alternatively one of said portions engaging with said keys whereby said outer tube rotates when said inner tube rotates, or alternatively another of said portions passing said keys, whereby said inner tube can freely rotate through a certain angle and can freely slide up and down through a certain length within said outer tube; and including grooves into which the top inner ends of said nozzles are confined.

2. An excavating apparatus, as claimed in claim 1, in which a suitable rotating angle between said inner and outer tubes can be optionally selected by an angle formed by a flat surface on one of said different diameter portions which comes into contact with the inner surface of said keys and another flat surface of said different diameter portions.

3. An excavating apparatus, as claimed in claim 1, wherein (1) a hole through which a fluid flows is passing through each of said nozzles, and (2) said grooves are formed on an annular split-bush which is divided into several parts and attached on said inner tube so that said bush is freely rotatable through a certain angle, and a hole passing through said inner tube is always connected with said holes passing through nozzles.

4. An excavating apparatus, as claimed in claim 1 and further comprising:

(1) an oil-pressure chamber containing a fluid of a certain volume provided within said outer tube at the bottom thereof;

(2) a cylinder, the top of which is open, disposed at the bottom of said oil-pressure chamber in a freely rotatable manner;

(3) a valve disposed at the bottom of said cylinder so as to open or close the bottom of said cylinder in accordance with the rotation of said cylinder;

(4) a piston head disposed at the bottom of said inner tube through a rod so as to be inserted into said cylinder; and (5) a chuck non-rotably, but slidingly attached on said rod whereby said piston head enters said cylinder when said inner tube moves toward said cylinder.

5. An excavating apparatus, as claimed in claim 4, in which said piston head is separated from said rod and a magnet is integrally fixed at said piston head to maintain the position of said piston head relative to said cylinder.

* * * * *